United States Patent [19]

Jessen

[11] Patent Number: 4,925,017

[45] Date of Patent: May 15, 1990

[54] CONTACT LENS STORAGE KIT

[75] Inventor: Kyle P. Jessen, Ogden, Utah

[73] Assignee: EEK, Inc., Ogden, Utah

[21] Appl. No.: 355,453

[22] Filed: May 22, 1989

[51] Int. Cl.[5] ..... A45C 11/04

[52] U.S. Cl. ..... 206/5.1

[58] Field of Search ..... 206/5.1

[56] References Cited

U.S. PATENT DOCUMENTS

| | | | |
|---|---|---|---|
| 3,085,584 | 4/1963 | Hollinger . | |
| 3,089,500 | 5/1963 | Stalcup | 206/5.1 |
| 3,124,240 | 3/1964 | Croan | 206/5.1 X |
| 3,268,068 | 8/1966 | Le Grand | 206/5.1 X |
| 3,695,280 | 10/1972 | Sturgeon . | |
| 3,741,377 | 6/1973 | Kreller | 206/5.1 X |
| 4,406,362 | 9/1983 | Thomas et al. | 206/5.1 |

FOREIGN PATENT DOCUMENTS

| | | | |
|---|---|---|---|
| 607642 | 10/1960 | Canada | 206/5.1 |
| 2824919 | 9/1979 | Fed. Rep. of Germany | 206/5.1 |
| 2310940 | 12/1976 | France | 206/5.1 |

*Primary Examiner*—William Price

[57] ABSTRACT

A temporary storage contact lens cleaning kit comprising: a storage case having a base with a bottle storage area upon which at least one removably mounted bottle containing contact lens cleaning and storage fluid is mounted; and a lens storage area upon which a pair of open topped storage cups are attached and structured to accommodate and hold a pair of contact lenses, and a pair of removable caps attached to the base and sized to secure and fluid seal the opening of each respective storage cup to hold within said cup a contact lens and various types of lens cleaning and storage contact lens solutions.

9 Claims, 4 Drawing Sheets

CONTACT LENS STORAGE KIT

FIELD

This invention relates to contact lens carrying and storage cases. In particular, it relates to an improved combination storage kit for temporary storage of contact lenses.

STATE OF THE ART

There are basically three types of non-disposable contact lenses: soft, hard, and rigid gas permeable lenses. Soft lenses are generally made of a hydrophilic transparent plastic (hydrooxyethylmethacrylate) that contains between 30% and 80% water. Hard lenses are generally made of a rigid plastic resin, polymethylmethacrylate. Rigid gas permeable lenses are made of a variety of hydrophobic, but oxygen-permeable materials.

Each lens type has different cleaning and storage fluid requirements. Specifically, soft contact lenses generally require both cleaning and disinfection to prevent bacteria, fungi, and other microorganism growths. Soft lenses are usually cleaned with a surfactant after every wearing, followed periodically by an enzymatic cleaner treatment to remove protein deposts that a surfactant does not eliminate. These cleaners are then rinsed with and stored in a saline solution. In addition, soft lenses must be disinfected with a heat or chemical treatment. Typical chemical disinfectant solutions are: (1) thimerosal in combination with either chlorhexidine or quaternary ammonium compound, and (2) filtered hydrogen peroxide solutions Hard lenses are cleaned in a solution to remove protein deposits, oils, and airborne contaminants with a solution generally friction rubbed in the palm of the hand. Hard lenses should be stored in a sterile soaking and wetting solution in order to maintain the lens wetting properties and prevent contamination. Usually, combination two-in-one solutions that combine cleaning and soaking or soaking and wetting, or three-in-one solutions combining all three cleaning, soaking, and wetting functions may be employed.

Rigid gas permeable lenses require the same care techniques as those required for hard lenses, but differing cleaning solutions.

Various storage and carrying cases for these contact lenses are known. Typically, they employ separate compartments within which each contact lens may be stored. Preferably, these compartments are filled with a lens cleaning or wetting solution, which disinfects and prevents the lens from drying out. In one common embodiment, the fluid fills a common reservoir which bathes each lens stored within compartments in communication with the common reservoir. These reservoirs can become contaminated, and therefore require their fluids to be frequently emptied and replaced. As a consequence, it is preferred that each lens storage compartment is structured to be separated and made smaller.

The contact lens fluids cannot be solely stored within the lens case reservoirs, because these fluids must be removed and applied to the lenses and rubbed in for more efficient cleaning before storage. Also, fresh fluid is generally required for cleaning and storage to maintain the fluid sterility. The fluids are therefore stored in separate containers, and then applied to the lenses and used to fill the storage reservoirs.

Conventional contact lens storage kits thus require: a lens storage case, separate fluid containers to treat the lenses for storage and re-insertion upon removal, and a carrying case for the lens storage case and containers. This requirement for a separate lens storage case, carrying case, and fluid containers is not only inconvenient to carry multiple items, but is generally awkward, because of the size of the bulky fluid containers. Oftentimes, these items have to be checked for transport, particularly for air travel where one's bags are generally stowed during flight. This makes it impractical for passengers to remove their contact lenses during flight, without having to carry the storage container and separate fluid bottles with them in the cabin. Removal and storage of lenses is even more of a problem when an airline passenger's luggage containing these lens storage articles is lost or delayed.

Conventional contact lens storage kits are generally designed for repeated, long term use. They thus contain sufficient quantities of cleaning and storage solution for many months use. The lens storage cases are also relatively large, in comparison to the lenses stored therein, for more permanent storage and thus are not disposable. These lens storage cases also have to be periodically cleaned to insure sterile storage conditions. There thus remains a need for a disposable temporary contact lens storage kit. Applicant's invention described below provides a disposable, light weight, compact, combination contact lens storage and carrying case, which avoids the above problems.

SUMMARY OF THE INVENTION

Applicant's invention consists of an improved combination storage and contact lens cleaning kit comprising: a storage case having a base with a lens storage area upon which a pair of open topped cups are attached and structured to hold a pair of contact lenses. Each separate cup is sized and has an opening structured to accommodate a contact lens when inserted therein. Removable caps structured to secure and close the opening of each respective cup are included. These caps are preferably attached to the base with flexible members to prevent loss when the caps are removed. When covering each respective cup, the caps secure the lens within the cup and provide a fluid seal to prevent loss of lens storage and cleaning fluids from each cup. The caps preferably snap or screw onto the cup to cover the opening to provide this fluid seal to prevent the lenses from drying out.

The storage base also has a fluid storage area adjacent to the lens storage area upon which is removably mounted at least one bottle of lens cleaning or storage fluid. The bottles contain a temporary supply of either lens cleaning fluid or saline solution for cleaning contact lenses, or filling each cup for lens storage. In one preferred embodiment, a bottle of saline solution fits within a ridge structure attached to the base which creates a storage compartment surrounding the bottle. The bottle is removably secured to the base by flaps attached to snap caps which extend beyond said caps and cover the bottle to secure said bottle within the storage compartment when the cap covers the cup. To remove the bottle, the flaps are unsnapped, thereby releasing the bottle for removal and use.

In another embodiment, the bottle is structured to removably slide into and out of a grooved slot defined by the base within the fluid storage area.

Each fluid bottle has a removable lid to expose the contents for use. The lid may be screwed on or structured to snap off. The type of fluid stored is dependent upon the lens storage and cleaning requirements outlined below. The bottle contains sufficient fluid to apply to the lenses for cleaning, as well as filling the storage cups. The lenses are then placed in the cups for temporary storage. After use, the lens storage kit, bottle, and fluid are then discarded.

Numerous types of contact lens cleaning, storage, and disinfection products are available for use with storage and cleaning kits for the different types of contact lenses. Examples of soft contact lens solution products are as follows:

Typical thimerosal-preserved saline solutions for use with contact lens cleaning kits are: BoilnSoak® produced by Alcon, which contains thimerosal, edetate disodium, sodium chloride, sodium borate and boric acid; Soft Mate® produced by Barnes-Hind, which contains thimerosal, edetate disodium, sodium chloride and sodium phosphates; Preserved Saline produced by Bausch & Lomb, which contains thimerosal, edetate disodium, sodium chloride, boric acid, and sodium borate. Examples of non-thimerosal-preserved saline are: Saline-Sensitive Eyes produced by Alcon, which contains sorbic acid edetate disodium, sodium chloride, and a borate buffer; ReNu SM produced by Bausch & Lomb, which contains Dymed SM, edetate disodium, sodium chloride, and boric acid; and Sorbi-Care® produced by Allergan, which contains sorbic acid, sodium chloride, sodium borate, boric acid, and a sequestering agent. Examples of non-preserved saline are: Soft Mate® Preservative Free produced by Barnes-Hind, which contains sodium chloride and a borate buffer; Murine® Non-Preserved produced by Ross, which contains sodium chloride and a borate buffer; and CIBA Vision® Saline produced by CIBA Vision, which contains sodium chloride. Examples of hydrogen peroxide disinfection systems are: Lens Plus® Oxysept SM 1 Disinfection Solution produced by Allergan, a catalase neutralization method, which contains hydrogen peroxide, sodium stannate, sodium nitrate, phosphate buffer, catalase, sodium chloride, edetate disodium mono & dibasic sodium phosphate; Quick-Sept SM produced by Bausch & Lomb, a saline dilution neutralization method, which contains hydrogen peroxide, sodium stannate, sodium nitrate, and phosphate buffer; and AOSEPT® Disinfection and Neutralization/Storage Solution produced by CIBA Vision, a platinum-coated catalytic disc method of neutralization, which contains hydrogen peroxide, sodium chloride, sodium stannate, sodium nitrate, and phosphate buffer. Examples of chemical disinfection solutions are: Flex-Care® Sensitive-Eyes produced by Alcon, which contains chlorhexidine, edetate disodium, sodium chloride, sodium borate, and boric acid; Soft Mate® Disinfecting Solution produced by Barnes-Hind, which contains chlorhexidine, edetate disodium, sodium chloride, povidone oxtylphenoxy (oxyethylene ethanol), and a borate buffer; and Hydro-Care® Cleaning and Disinfecting produced by Allergan, which contains thimerosal, tris and bis (2 hydroxyethyl) tallow ammonium chloride, sodium chloride, sodium bicarbonate, sodium phosphates, polysorbate 70, polyhema, propylene glycol hydrochloric acid and buffers. Examples of daily surfactant cleaners are: Opti-Clean® produced by Alcon, which contains thimerosal, edetate disodium Tween 21, polymeric cleaning agents, and hydroxyethylcellulose, Soft Mate® produced by Barnes-Hind contains thimerosal, edetate disodium, sodium chloride, octylphenoxy (oxyethylene), ethanol, and hydroxyethyl-cellulose; and Preflex® Sensitive Eyes produced by Alcon, which contains sorbic acid, edetate disodium, sodium chloride, sodium phosphates, tyloxapol, hydroxyethylcellulose, and polyvinyl alcohol. Examples of lubricants & wetting agents are: Murine® Lubricating & Rewetting Drops produced by Ross, which contains sorbic acid, edetate disodium, sodium chloride, sodium borate, boric acid, and hydroxyethylcellulose; Sensitive Eyes SM Drops produced by Bausch & Lomb, which contains sorbic acid, edetate disodium, sodium chloride, and a borate buffer; and CIBA Vision® Lens Drops produced by CIBA Vision, which contains sorbic acid, edetate disodium, sodium chloride, sodium borate, boric acid, and hydroxyethylcellulose. Examples of Weekly Cleaners are: Soft Mate® Weekly Cleaning--Hydramat II Produced by Barnes-Hind, containing thimerosal, edetate disodium, and cleaning agents; ReNuϕ Effervescent Enzymatic Cleaner produced by Bausch & Lomb, which contains subtilisin, sodium chloride, sodium carbonate, polyethylene glycol, and tartaric acid; Extenzyme SM Protein Cleaner produced by Allergan, which contains edetate disodium, papain, sodium chloride, sodium carbonate, and sodium borate.

Examples of hard contact lens solution products are as follows:

Wetting solution examples are: Wetting Solution produced by Barnes-Hind, which contains benzalkonium chloride edetate disodium, and polyvinyl alcohol; Adapt® produced by Alcon, which contains thimerosal, edetate disodium, Adsorbobase® (povidone and other water soluble polymers), and hydroxyethylcellulose; and hy-Flow® produced by CooperVision, which contains benzalkonium chloride, edetate disodium, polyvinyl alcohol, hydroxyethylcellulose, sodium chloride, potassium chloride, and sodium hydroxide. Cleaning solution examples are: Concentrated Cleaner produced by Bausch & Lomb, which contains anionic and other surfactants, friction-enhancing agents, and sodium chloride; Murine® Daily Contact Lens Cleaner produced by Ross, which contains sorbic acid, edetate disodium, polyoxamine, borate buffer, sodium chloride, and hydroxypropylemethylcellulose; and Titan® produced by Barnes-Hind, which contains benzalkonium chloride, edetate disodium, and nonionic surfactants. Soaking solution examples are: Soakare® produced by Allergan, which contains benzalkonium chloride edetate disodium, and sodium hydroxide; Soquette® produced by Barnes-Hind, which contains benzalkonium chloride edetate disodium, and chlorobutanol; and Lobob® produced by Lobob, which contains benzalkonium chloride and edetate disodium. Combination cleaning/soaking solution examples are: Contique® Cleaning & Soaking Solution produced by Alcon, which contains benzalkonium chloride, edetate disodium, and triethanolamine detergents; Cleaning & Soaking Solutions produced by Barnes-Hind, which contains benzalkonium chloride and edetate disodium; and Sereine® Soaking & Cleaning Solution produced by Optikem, which contains benzalkonium chloride, edetate disodium, and surfactants. Combination wetting/soaking solution examples are: Wet-N-Soak produced by Allergan, which contains benzalkonium chloride, edetate disodium, and polyvinyl alcohol; Wetting & Soaking Solution produced by Barnes-Hind, which contains benzalkonium chloride, edetate disodium, polyvinyl alcohol, hydroxyethylcellulose, octylphenozy (Oxyethylene) ethanol; and Wetting & Soaking Solution produced by Bausch & Lomb, which contains chlorhexidine, edetate disodium, hydrophilic polyelectrolyte, polyvinyl alcohol, hydroxyethylcellulose. Examples of all-purpose solutions are: Lens Mate® produced by Alcon, which contains benzalkonium chloride, edetate disodium, polyvinyl alcohol, and hydroxypropylmethylcellulose; One Solution® produced by Barnes-Hind, which contains benzalkonium chloride, edetate disodium, and polyvinyl alcohol, hydroxyethylcellulose; and Total® All-in-One produced by Allergan, which contains benzalkonium chloride, edetate disodium, polyvinyl alcohol, and hydroxyethylcellulose. Examples of Lubricant & Conditioning Solutions are: Lens-Wet SM produced by Allergan, which contains thimerosal, edetate disodium, polyvinyl alcohol, sodium chloride, and sodium phosphates; Comfort Drops® produced by Barnes-Hind, which contains benzalkonium chloride, edetate disodium, and a nonionic surfactant; and Clerz® produced by CooperVision, which contains thimerosal, edetate disodium, sorbic acid, poloxamer 407, sodium borate, hydroxyethylcellulose, sodium chloride, and potassium chloride.

Examples of rigid gas permeable contact lens products are as follows:

Examples of Daily Cleaners are: Opti-Clean® produced by Alcon, which contains thimerosal, edetate disodium, Tween 21 polymeric cleaning agents; Gas Permeable Daily Cleaner produced by Barnes-Hind, which contains thimerosal, edetate disodium, and nonionic cleaning agents; and Concentrated Cleaner produced by Bausch & Lomb, which contains anionic sulfate surfactant, friction enhancing agents, and sodium chloride. Examples of Weekly Cleaners are: Enzymatic Cleaner for Extended Wear Lenses produced by Alcon, which contains purified pork pancreatin; Opti-Zyme® Enzymatic Cleaner produced by Alcon, which also contains purified pork pancreatin; and ProFree/GP SM Weekly Enzymatic Cleaner produced by Allergan, which contains edetate disodium, papain, sodium chloride, sodium carbonate, and sodium borate. Examples of combination wetting/soaking solutions are Wet-N-Soak SM produced by Allergan, which contains benzalkonium chloride, edetate disodium, and polyvinyl alcohol; Gas Permeable Wetting & Soaking Solution produced by Barnes-Hind, which contains thimerosal, chlorhexidine, edetate disodium, and polyvinyl alcohol; and Wetting & Soaking Solution produced by Bausch & Lomb, which contains chlorhexidine, edetate disodium, polyvinyl alcohol, hydroxyethylcellulose, and hydrophilic polyelectrolyte. Examples of combination disinfection/conditioning solutions are: Flex-Care® Sensitive Eyes produced by Alcon, which contains chlorhexidine, edetate disodium, sodium chloride, sodium borate, and boric acid; HGP SM Conditioning Solution produced by CooperVision, which contains chlorhexidine, edetate disodium polyvinyl alcohol, and hydroxyethylcellulose, and Boston SM Conditioning produced by Polymer Tech., which contains chlorhexidine, edetate disodium, polyvinyl alcohol, hydroxyethylcellulose, hydrophilic polyelectrolyte, and other hydrophilic polymers.

As can be seen from this abbreviated contact lens solution list, numerous cleaning and storage solutions can be utilized with the three types of contact lenses. Because of the similarity of active ingredients used for each types of lens, there will shortly be available a universal combination cleaning/disinfection/storage solution for all types of lenses. Although applicant's contact lens temporary storage and cleaning kit can be used in association with any number of the above solution types, it is contemplated that a universal combination cleaning/disinfection/storage solution will ultimately be utilized to minimize the number of different types of storage bottles required for each kit. In the interim, the base may be sized to accommodate several different types of removable bottles containing various types of cleaning and storage solutions for use with differing lens types.

It is also contemplated within this invention that the kit may be produced with the cups containing contact lens solutions sealed therein with closed caps to minimize the number of bottles required. This cup storage embodiment is particularly suited for soft contact lens storage, which presently requires two types of cleaning/storage solutions. If the lens storage solution is initially supplied in the cups of the kit, only a bottle of cleaning solution is required.

Preferably, the kit has a rectangular base sized approximately 2×3 inches to enable it carry one, two, or three contact lens fluid bottles. This size makes the kit readily carried in a pocket or purse. Where additional solutions are required, the kit is packaged in a small hermetically sealed box containing additional lens fluid bottles. For use on airlines, the kit may be packaged with solutions which accommodate both hard and soft lenses. These solutions are held in safety-sealed bottles meeting FDA standards.

Applicant's temporary storage case is preferably made of extruded or molded plastic, wherein the base, cups, caps, and connecting members are made of a single piece. This uni-body construction not only minimizes cost, but prevents the loss of the caps. The storage case may therefore be constructed of any FDA approved light weight material, such as polypropylene, impervious to contact lens storage and cleaning fluids.

The storage kit and bottles may be colored or patterned to suit the preference of a user, or may be embellished with an advertising logo or user instructions. The kit is used wherever temporary removal or cleaning of contact lenses is required. It is particularly adapted for in-flight use by airline passengers. For in-flight use, the kit is constructed of a light weight, disposable plastic storage case for contact lenses. The kit is vacuum sealed with an FDA-approved, safety-sealed bottle, which contains a two-day supply of sterile, non-Thimerosal saline solution. A passenger may remove his or her contact lenses and store the same after cleaning for the duration of the flight. Upon landing, the lenses may be re-inserted after disinfection, and the kit discarded.

Applicant's invention thus provides an improved disposable temporary storage and cleaning kit for contact lenses.

DESCRIPTION OF THE ILLUSTRATED EMBODIMENTS

Figure 1:
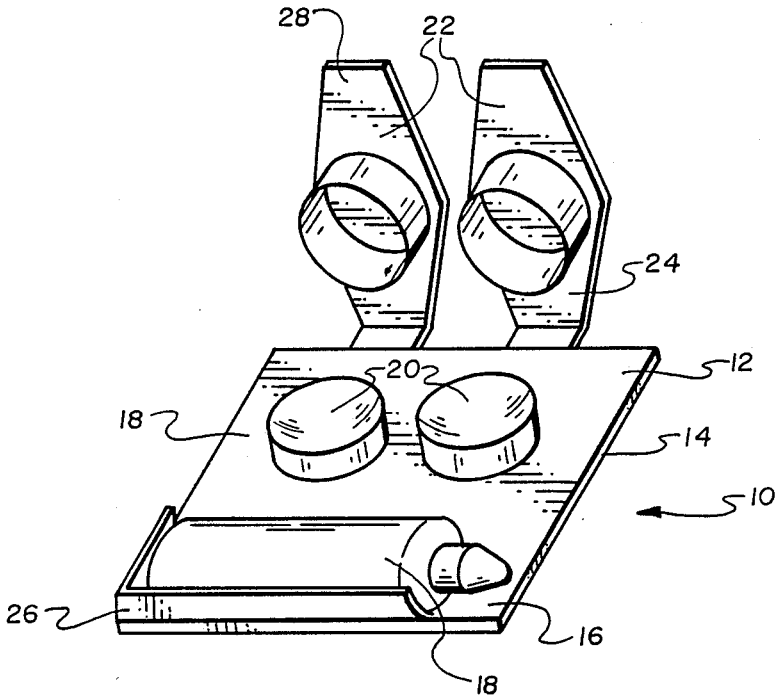
FIG. 1 illustrates a perspective view of one preferred embodiment of the invention.

FIG. 1 illustrates one preferred embodiment of applicant's invention 10. The lens storage kit 10 comprises: a storage case 12 having a base 14 with a bottle storage area 16 upon which at least one removably mounted bottle 18 containing contact lens cleaning and lens storage area 16 upon which a pair of open topped storage cups 20 are attached and structured to accommodate and separately hold a pair of contact lenses. A pair of removable caps 22 are attached with flexible members 24 to the base 14. The caps 22 are sized and structured to secure and fluid seal the opening of each respective storage cup 20 to hold within said cup a contact lens and various types of lens cleaning and storage contact lens solutions. The bottle 18 is held within the storage area 16 by a ridge 26 attached to the base 14 forming an open topped compartment into which the bottle 18 is placed. The caps 22 have flaps 28 which extend beyond the cups 20 when sealed, to secure the bottle 18 within the storage area.

To utilize the storage kit, the caps 22 are opened, releasing the bottle 18. The bottle 18 is then removed and opened to treat the user's contact lenses and fill the storage cups 20. The contact lenses are then placed within each respective cup 20, and sealed therein with the caps 22.

Figure 2:
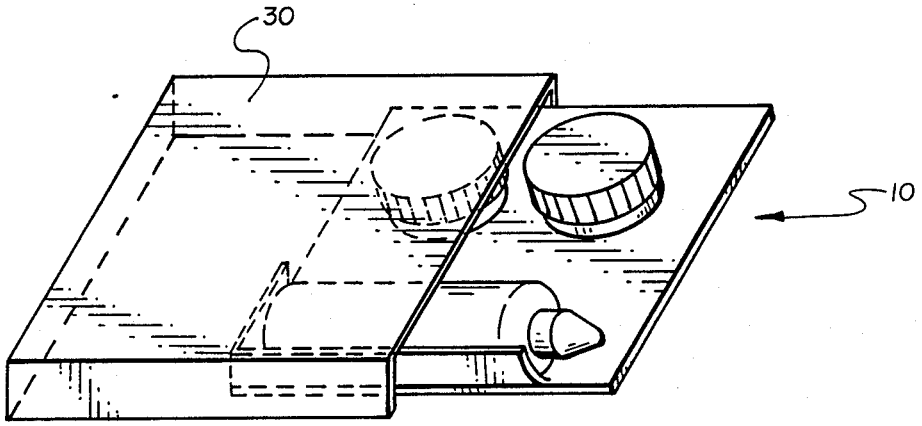
FIG. 2 illustrates another preferred embodiment stored in a box.

FIG. 2 illustrates how the embodiment of applicant's invention 10 shown in FIG. 1 is stored within a storage box to insure sterility of the components.

Figure 3:
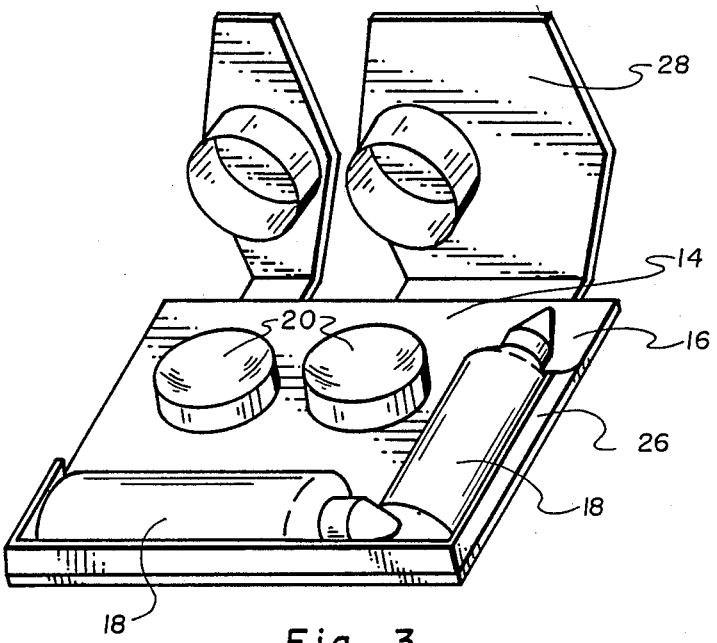
FIG. 3 illustrates a preferred embodiment of the invention with two bottles.

FIG. 3 illustrates an embodiment of applicant's invention 10 with the base 14 storage area 16 expanded laterally to accommodate an additional bottle 18 placed along the perimeter of the base 14 at right angles to the first bottle 18 as shown. The ridge 26 is extended along the base 14 at right angles to form a second open topped compartment into which the second bottle 18 is placed. The flap 28 of the cap 22 proximate the second open topped compartment is extended laterally to cover and secure the second bottle 18 within the second open topped compartment. This embodiment of applicant's invention is particularly suited for carrying a separate disinfectant/cleaning solution in one bottle 18, and a storage saline solution in the other bottle 18, although other combination solutions could be stored.

Figure 4:
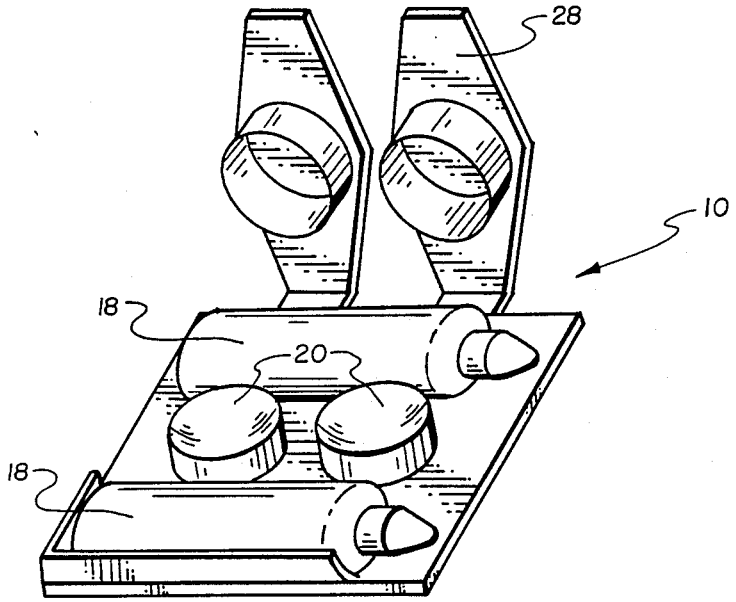
FIG. 4 illustrates another preferred embodiment of the invention with two bottles.

FIG. 4 illustrates another embodiment of applicant's invention 10 for use with two bottles 18 of contact lens solution placed on both sides of the storage cups 20.

Figure 5:
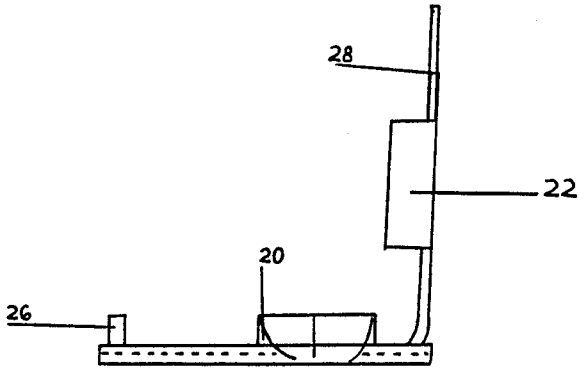
FIG. 5 illustrates a side view of another embodiment.

FIG. 5 is a side view of the embodiment illustrated in FIG. 1 with the caps 22 open and the bottle 18 removed.

Figure 6:
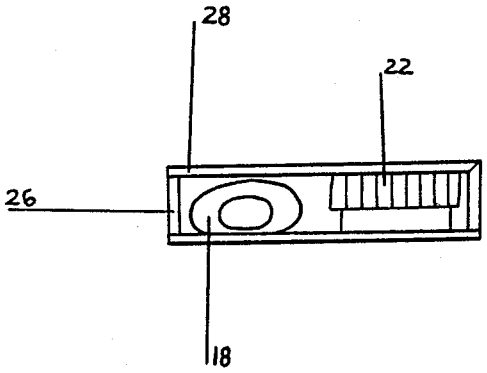
FIG. 6 illustrates another side view of the embodiment shown in FIG. 1

FIG. 6 is a side view of the embodiment illustrated in FIG. 1 with the caps 22 closed securing the bottle 18 within the storage compartment.

Figure 7:
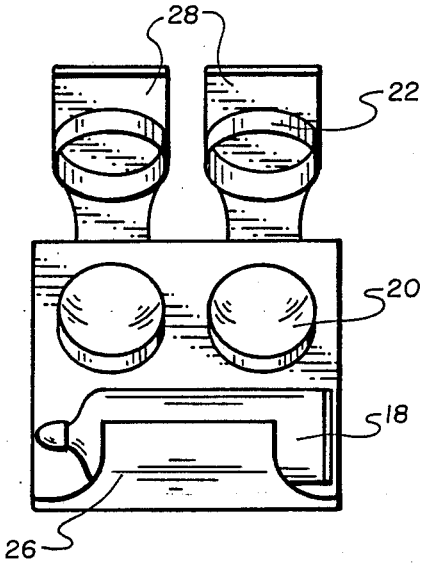
FIG. 7 illustrates another embodiment of applicant's invention.

FIG. 7 illustrates another embodiment of applicant's invention 10 with rounded cups utilizing a slotted groove 30 formed by the ride 26 into which a bottle may be inserted and secured therein by flaps 28.

Figure 8:
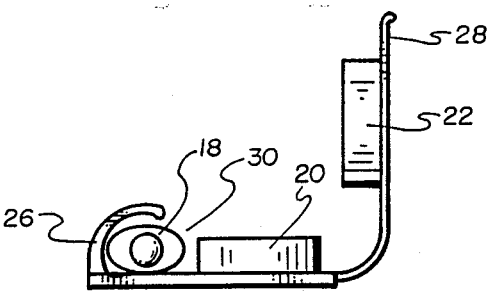
FIG. 8 illustrates a side view of another embodiment.

FIG. 8 is a side view of the embodiment shown in FIG. 7 with the caps 22 open.

Figure 9:
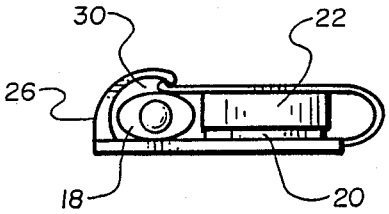
FIG. 9 illustrates another side view of the embodiment shown in FIG. 7.

FIG. 9 is a side view of the embodiment shown in FIG. 7 with the caps 22 closed securing the bottle 18 to the kit 10.

Although this specification has made reference to the illustrated embodiments, it is not intended to restrict the scope of the appended claims. The claims themselves contain those features deemed essential to the invention.

I claim:

1. A temporary storage contact lens kit comprising:

a. a storage case having a base with a bottle storage area surrounded by ridge structure defining an open topped storage compartment sized to accommodate at least one bottle containing contact lens cleaning and storage fluid, and a lens storage area upon which a pair of open topped storage cups are attached and structured to hold a pair of contact lenses, b. a pair of removable caps attached to the base and sized to secure and fluid seal the opening of each respective storage cup to hold within said cup a contact lens and various types of lens cleaning and storage contact lens solutions, c. an openable storage bottle containing desired lens cleaning and storage solutions removably mounted onto the bottle storage area, and d. flaps attached to the caps which extend beyond said caps and cover the bottle to hold said bottle within the storage compartment when the cap covers the cup.

2. A temporary storage contact lens kit according to claim 1, wherein the caps are attached to the base with flexible members to prevent loss when the caps are removed.

3. A temporary storage contact lens cleaning kit according to claim 1, wherein the caps are structured to snap onto each cup to provide a fluid seal to prevent the contact lenses stored within each compartment from drying out.

4. A temporary storage contact lens kit according to claim 1, wherein the bottle contains a two day supply of lens cleaning and disinfection fluid.

5. A temporary storage contact lens kit according to claim 1, wherein the ridge structure of the base defines a slot sized to accommodate the bottle and structured to allow said bottle to removably slide into and out of the grooved slot when not secured therein by the flaps.

6. A temporary storage contact lens kit according to claim 1, wherein the fluid bottle has a screw on lid to allow the bottle to be emptied.

7. A temporary storage contact lens kit according to claim 1, wherein the lid is structured to snap off the bottle.

8. A temporary storage contact lens kit according to claim 1, wherein the solution in the bottle comprises a universal combination cleaning/disinfection/storage solution for all types of contact lenses.

9. A temporary storage contact lens kit according to claim 1, wherein the caps are initially closed to cover the cups and seal within the storage cups a desired contact lens solution, and are then opened and re-closed to store therein a pair of contact lenses.

* * * * *